United States Patent [19]

Olyphant, Jr.

[11] 3,995,277

[45] Nov. 30, 1976

[54] MICROSTRIP ANTENNA

[75] Inventor: Murray Olyphant, Jr., Lake Elmo, Minn.

[73] Assignee: Minnesota Mining and Manufacturing Company, St. Paul, Minn.

[22] Filed: Oct. 20, 1975

[21] Appl. No.: 623,987

[52] U.S. Cl. ..... 343/846; 343/853

[51] Int. Cl.[2] ..... H01Q 9/38

[58] Field of Search ..... 343/700, 829, 846, 853

[56] References Cited

UNITED STATES PATENTS 3,938,161 2/1976 Sanford ..... 343/853

*Primary Examiner*—Eli Lieberman

*Attorney, Agent, or Firm*—Alexander, Sell, Steldt & DeLaHunt

[57] ABSTRACT

Microstrip antenna having one or more arrays of resonant dipole radiator elements. The radiator elements have an E coordinate dimension of approximately $$\frac{\lambda_o}{2\sqrt{\epsilon_r \mu_r}}$$

A feed line made up of similar, series-connected, semiresonant, approximately half-wave sections distributes energy to and provides the desired phase relationship between the radiator elements. The radiator elements are conductively joined to alternate sides of the feed line at successive junctions of the half-wave sections to provide an array, with the feed line being electrically coupled to each radiator element in the array along an edge of the radiator element that intersects its E coordinate. The H coordinates of the radiator elements lie generally along a straight line through the radiator elements of the array. The radiator elements and feed line sections are in a broad surface which is uniformly spaced from a ground element by a dielectric sheet.

45 Claims, 7 Drawing Figures

MICROSTRIP ANTENNA

CROSS REFERENCE TO RELATED APPLICATION

Applicant's co-pending U.S. application Ser. No. 623,988, filed this same day and assigned to common assignee discloses a microstrip antenna comprising resonant dipole radiator elements directly and conductively joined by bridge elements. Each bridge element has approximately a phase reversal from end to end and joins two adjacent radiator elements at points of opposite phase. A terminal on a radiator element feeds energy to more remote parts of the array through the alternating radiator and bridge elements. Such an array utilizes the phase reversal property that exists across a dipole radiator element in the E coordinate direction to distribute energy to the adjacent radiator elements. In such an array the E-plane of radiation is generally parallel to a straight line through the radiator elements.

BACKGROUND OF THE INVENTION

There is a growing need for low cost, light-weight, low profile, readily mass-producible, high aperture-efficiency antennas of useful bandwidth in a variety of mass market applications.

The desirable characteristics of low cost, light-weight, low profile and mass producibility are provided in general by printed circuit antennas. The simplest forms of printed circuit antennas are "microstrip" antennas wherein flat conductive elements are spaced from a single essentially continuous ground element by a single dielectric sheet of uniform thickness. Such antennas are easily constructed from one layer of double clad circuit board material. Microstrip antennas with increased aperture efficiency and increased bandwidth would be very desirable.

One type of microstrip antenna utilizes radiating monopoles, each of which produce an omnidirectional radiation pattern in the plane of the antenna surface. Such an antenna is disclosed in U.S. Pat. No. 3,377,592 wherein short sections of otherwise uniform microstrip transmission lines are displaced in one direction from the centerline of the transmission line at intervals of one wavelength. All the outside corners of any one transmission line acquire the same charge simultaneously to produce monopoles and a radiation pattern that has a principal lobe that is tangential to the surface of the antenna.

A second type of microstrip antenna utilizes thin conductive resonant dipoles radiator elements, each of which produces a radiation pattern having a principal lobe broadside (perpendicular) to the antenna surface. Each of such dipole radiator elements has two orthogonal coordinates that respectively define E and H planes of electromagnetic radiation for that radiator element. The E coordinate dimension of each radiator element is approximately one-half the dielectric wavelength $$\frac{\lambda o}{\sqrt{\epsilon_r \mu_r}},$$

where $\lambda o$ is the free space wavelength, $\epsilon_r$ is the relative dielectric constant and $\mu_r$ is the relative permeability of the dielectric sheet. The dielectric sheet is generally $$\frac{\lambda o}{100\sqrt{\epsilon_r \mu_r}} \text{ to } \frac{\lambda o}{10\sqrt{\epsilon_r \mu_r}}$$

thick with the preferred range being $$\frac{\lambda o}{75\sqrt{\epsilon_r \mu_r}} \text{ to } \frac{\lambda o}{15\sqrt{\epsilon_r \mu_r}}.$$

In an antenna it is desirable that such radiator elements radiate in a predetermined amplitude and phase relationship with respect to each other. The amplitude relationship may be a uniform illumination wherein all radiator elements contribute equally to a radiation pattern. Alternatively, the amplitude relationship may be a tapered distribution. The radiator elements should radiate in phase with respect to each other to create a broadside beam. An off-broadside beam may be created by having a progressive phase shift along rows or columns of radiator elements.

One class of microstrip antennas utilizing resonant dipole radiator elements employs capacitative coupling of energy to radiator elements. Such an antenna is disclosed in U.S. Pat. No. 3,016,536 wherein rectangular resonant dipole radiator elements are distributed on a broad surface. The E coordinate dimension of each radiator element is approximately $$\frac{\lambda o}{2\sqrt{\epsilon_r \mu_r}}.$$

The H coordinate dimension of each radiator element is considerably less than the E coordinate dimension. Such radiator elements form collinear arrays in the E coordinate direction with capacitative coupling between radiator elements for energy transfer. The center dipole of each collinear array consists of a pair of quarter wavelength radiator elements that form a balanced center-fed dipole. Several center-fed dipoles and their respective collinear arrays are driven from a balanced line to provide a two dimensional planar array. Such an antenna requires a balanced drive, has a poor aperture efficiency and a narrow bandwidth. The antenna has a rather large thickness because it is designed to use the ground plane as a reflector.

Another example of resonant dipole microstrip antennas utilizing capacitative coupling is contained in EMI-Varian Limited Bulletin PA2 11/73, entitled "Printed Antennae 2–36 GHz". In such an antenna the radiator elements are capacitatively coupled at various spacings to one or more feed lines running parallel to their E coordinate. The disclosed antenna has demonstrated low aperture efficiencies and poor side lobe control.

A second class of microstrip antennas utilizing resonant dipole radiator elements employs conductive coupling of energy to radiator elements. Antennas of this class are disclosed in U.S. Pat. No. 3,803,623 (Charlot) and U.S. Pat. No. 3,811,128 (Munson) and by Munson (I.E.E.E. Transactions on Antennas and Propagation, January, 1974, pp. 74–78). The E coordinate dimension of the radiator elements is approximately $$\frac{\lambda o}{2\sqrt{\epsilon_r \mu_r}}.$$

The H coordinate dimension may be greater or lesser than the E coordinate dimension. The individual input impedance of such radiator elements at frequencies around resonance is typically in the convenient range of 50 to 150 ohms depending on element dimensions and dielectric substrate characteristics.

A corporate feed network distributes energy between the transmission line and a plurality of microstrip radiator elements. A corporate feed network in microstrip comprises an interconnected pattern of thin conductive strips which connect the radiator elements into arrays. A terminal on the corporate feed network of an array serves for connection to a transmission line. Such a terminal may be connected directly to the transmission line or connected indirectly to the transmission line through additional corporate feed network strips.

A corporate feed network may be provided by a sequence of power dividers and tapered feed line sections or other impedance transformers which serve to distribute the desired amount of energy directly from (to) the transmission line to (from) each radiator element. The lengths of the feed line sections determine the phase relationship between the transmission line and each radiator element and thus control the phase relationship between radiator elements. Two dimensional arrays of up to four or possibly eight radiator elements interconnected by a corporate feed network can be designed to produce a good aperture efficiency in the range of 90 percent based on ground element area. For arrays of greater numbers of radiator elements a decreased aperture efficiency is observed with conventional corporate feed because the corporate feed network becomes increasingly more extensive. The more extensive feed network necessitates increasing the spacing between the radiator elements, with such increased radiator element spacing in turn significantly reducing the aperture efficiency. such proliferating feed lines also become lengthy which increases feed line losses. The proliferating feed lines often have lengths of various multiples of dielectric wavelengths such that slight changes in frequency produce undesirable phase shifts between radiator elements.

SUMMARY OF THE INVENTION

The present invention provides improved distribution of energy to resonant dipole radiator elements in a microstrip antenna. Antennas utilizing the present invention can be designed to have increased aperture efficiency and increased bandwidth when compared to other microstrip antennas utilizing resonant dipole radiator elements.

The present invention utilizes a thin conductive feed line to distribute power to and control the phase relationship between the radiator elements in an array. The feed line is made up of series-connected, semi-resonant sections, each electrically approximately one half-wavelength long (in the range of 150° to 210°). Where the feed line sections extend between adjacent radiator elements, they have a maximum width that is less than one-fourth the dielectric wavelength $$\frac{\lambda o}{\sqrt{\epsilon_r \mu_r}}.$$

The radiator elements are conductively joined to alternate sides of the feed line at successive junctions of the feed line sections with the feed line being electrically coupled to each radiator element of the array along an edge of the radiator element that intersects its E coordinate.

The resultant array has a terminal on a radiator element off that radiator element's H coordinate or at the junction of two half-wave sections. The terminal may connect the array to an unbalanced transmission line either directly, or indirectly through a further feed network. Preferably the terminal is located on an edge of a radiator element that intersects that radiator element's E coordinate or at the junction of two half-wave sections of the feed line.

The present invention provides an array of dipole radiator elements that radiate approximately in phase with respect to each other. Because the E coordinates of any adjacent pair of radiator elements in the same array are generally parallel and that pair is fed at opposite ends of their E coordinates (where joined to the feed line), the pair radiates in phase.

The radiator elements and feed line are electrically interactive, apparently thus reducing the phase shift per unit length of feed line over the region of coupling therebetween. It is believed that this contributes to increased bandwidth for the array (hence, less susceptibility to changes in frequency and properties of the dielectric sheet). The radiator elements may be arranged with their H coordinates extending generally along a straight line through the radiator elements of the array to produce a compact array that permits maximum utilization of circuit board area (for high efficiency) and has wide bandwidth. It is believed that the straight line arrangement of radiator elements is possible at least in part due to the physically longer half-wave sections produced by the interactive coupling. The straight line arrangement inherently produces beneficial coupling between the edges of the radiator elements and the adjacent half-wave sections of feed line.

Antennas utilizing the present invention do not require an elaborate corporate feed network and thus provide high efficiency by minimizing feed network losses and permitting close spacing of radiator elements. High efficiency antennas can achieve a desired antenna gain with a relatively small area of circuit board thus offering the additional advantage of low weight and low cost.

Antennas utilizing the present invention have surprisingly resulted in a significant increase in half-power bandwidth compared to conventional resonant dipole microstrip antennas. Therefore, antennas utilizing the present invention have a low sensitivity to changes in frequency and in the properties of the dielectric sheet.

Antennas with uniformly illuminated arrays are easily designed with the present invention because they can be formed from modular building blocks. For example, an array may be easily formed once the geometries of the radiator element and half-wave sections are established by simple repetition of such elements. Once one array is formed, simple repetition can provide a plurality of arrays. Because each array requires only one terminal for connection to a transmission line, a plurality of such arrays can be formed into an antenna by a simple and hence easily designed corporate feed network. Arrays utilizing the present invention may also be easily interconnected by bridge elements as described in applicant's copending application Ser. No. 623,988.

Arrays of the present invention are unexpectedly easy to match to common feed line impedances. In a typical situation the impedance at a terminal of an array may be inherently matched to 50 ohms with a voltage standing wave ratio (VSWR) of less than 1.5.

If a terminal on an array for connection to a transmission line is near the center of the array, that terminal can be used to feed signals to or accept signals from radiator elements on either side of it to produce an antenna array whose beam direction is inherently stable with respect to changes in frequency and in the dielectric sheet properties such as dielectric constant and thickness.

To a first order approximation, the E coordinate dimension of a dipole radiator element in relation to the dielectric constant of the dielectric sheet determines a possible range of operating frequency for the radiator element. To a similar first order approximation, the half-wave section which interconnects two radiator elements determines the phase relationship between the two radiator elements when they are operating as an antenna. In an array that utilizes the present invention and has a broadside beam, to a first order approximation there is 180° of phase shift along each half-wave section.

The radiator elements can be various sizes and shapes. The E coordinate dimension of each radiator element should be approximately $$\frac{\lambda o}{2\sqrt{\epsilon_r \mu_r}}$$

Their H coordinate dimensions can have differing lengths and it is believed the illumination of an array can be tapered by adjusting the H coordinate dimensions. Preferably the natural resonant frequency modes in the E and H coordinate dimensions for any given radiator element are different. The individual radiator elements may be symmetrical or asymmetrical and need not have the same shape. To produce a very compact, highly efficient antenna with wide bandwidth, the radiator elements of each array are arranged with their H coordinates generally along a straight line through the radiator elements of the array.

The half-wave sections of feed line can be various sizes and shapes as long as they provide approximately a phase reversal (150° to 210°) from end to end at the operating wavelength $\lambda o$. Half-wave sections can vary in width. Relatively narrow sections have a relatively high characteristic impedance when considered as sections of a transmission line. Such characteristic impedance can be determined from Wheeler's Wide Strip Approximation Chart (Microwave Engineers Handbook. Vol. 1, 1971, publisher: Horizon House-Microwave Incorporated, p. 137) which gives impedance in terms of strip width, dielectric constant and dielectric thickness. Relatively speaking a narrower strip will generally have less phase shift per unit length. It is believed that if half-wave sections are too narrow they will not effectively transmit energy. Maximum width of half-wave sections is one-fourth the dielectric wavelength $$\frac{\lambda o}{\sqrt{\epsilon_r \mu_r}}$$

and is preferably less than one-eighth the dielectric wavelength. It is believed that if the half-wave sections are too wide they will interfere with the operation of the array. While the half-wave sections are believed not to radiate significantly, they are semi-resonant in the sense that they carry a standing wave when they are operating as part of the antenna. The half-wave sections of the present invention do not impedance match to distribute power to the individual radiator elements as is done in a corporate feed network. An array of the present invention is impedance matched if at all only at its terminal or terminals.

Once an array of the present invention is built, it is believed that similar arrays can be designed to operate at other desired frequencies by suitably scaling the array pattern and dielectric sheet thickness in the approximate ratio of the desired wavelength to the wavelength of the working model.

As previously described, to produce a very compact, highly efficient array with wide bandwidth, the H plane of radiation in the direction of maximum gain according to the present invention is generally parallel to a straight line through the radiator elements. In contrast, in applicant's aforementioned copending application Ser. No. 623,988, the E plane of radiation in the direction of maximum gain is generally parallel to a straight line through the radiator elements. For convenience the radiation mode of the present invention is referred to as the H plane mode and the radiation mode of applicant's copending application Ser. No. 623,988 as the E plane mode. Many physical configurations of radiator elements formed into an array by thin conductive strips will electrically operate in the H plane mode according to the present invention at one frequency and will electrically operate in the E plane mode according to applicant's copending application at another frequency.

Figure 1:
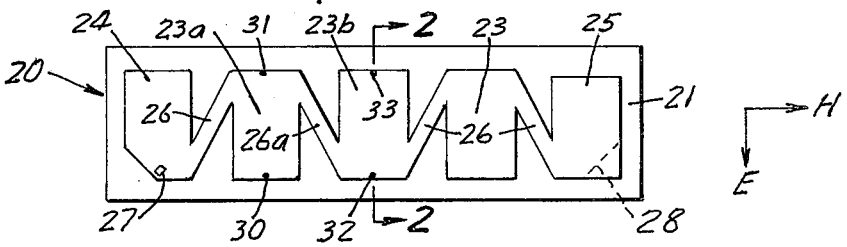
FIG. 1 is a plan view of a first embodiment of an antenna according to the present invention wherein the half-wave sections of the feed line pass through the radiator elements.
Figure 3:
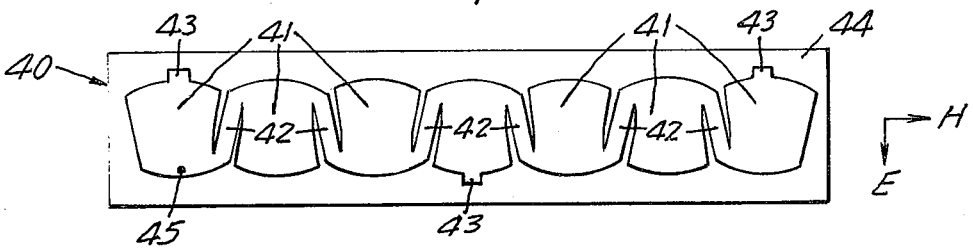
FIG. 3 is a plan view of a second embodiment of an antenna according to the present invention wherein the half-wave sections of the feed line pass through the radiator elements.
Figure 5:
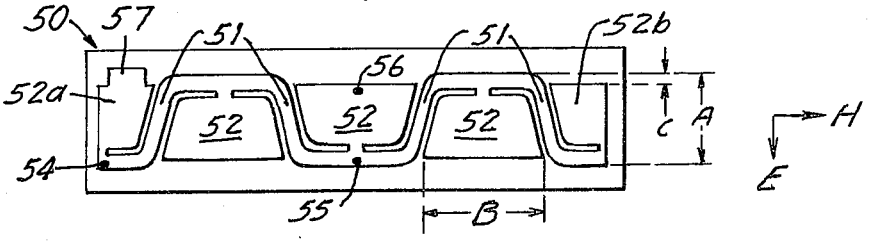
FIG. 5 is a plan view of a third embodiment of an antenna according to the present invention wherein the half-wave sections are closely coupled to the radiator elements.

The electrical coupling between the feedline and the radiator elements includes both a direct conductive connection at a junction of half-wave sections of the feedline, and additional distributed electrical coupling between the feedline and the edge of the radiator element to which the direct connection is made. Such additional distributed coupling can be mostly conductive, mostly capacitative or a combination thereof. Such coupling has been categorized into groups. One group includes those arrays where the series-connected half-wave sections of feed line pass through the radiator elements such as shown in FIGS. 1 and 3. Such half-wave sections pass through the radiator elements adjacent an edge of each radiator element that intersects that radiator element's E coordinate. A second group includes those arrays where the series connected half-wave sections of feed line are conductively joined to and closely coupled to the radiator elements such as shown in FIG. 5. Such half-wave sections pass adjacent to and spaced from an edge of each radiator element that interests that radiator element's E coordinate. The spacing between the half-wave sections and the radiator element is less than $2t$ and preferably less than $t$ along most of the length of that edge of the radiator element were $t$ is the thickness of the dielectric sheet. Such spacing can have various lengths and widths so that the first and second groups mentioned above effectively blend together to form a continuum.

DESCRIPTION OF THE PREFERRED EMBODIMENT

Figure 2:
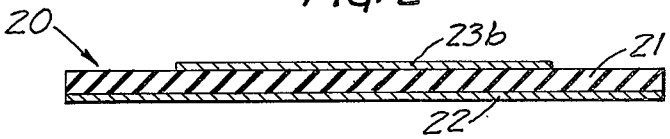
FIG. 2 is an enlarged sectional view along the line 2—2 in FIG. 1.

As shown in FIGS. 1 and 2, an antenna 20 is made from double copper-clad low-loss dielectric sheet 21 by etching one copper layer to form radiator elements 23, 24 and 25 and half-wave sections 26. The feed line is made up of series connected approximately half-wave sections with the radiator elements conductively joined to alternate sides of the feed line at the junctions of the feed line sections. The feed line passes through each connected radiator element adjacent an edge which intersects that radiator element's E coordinate. The other copper layer provides a ground element 22. The dielectric sheet 21 is polytetrafluoroethylene reinforced with glass fiber cloth, the sheet meeting U.S. military specification MIL-P-13949E Grade GX with a relative dielectric constant $\epsilon_r$ of about 2.45, a relatively permeability $\mu_4$ of 1.0 and a thickness of about 1.50 mm. Each copper layer is about 34 micrometers thick. The rectangular radiator elements 23 are each 1.18 cm by 1.58 cm. The rectangular radiator element 24 is 1.13 cm by 1.60 cm and has one corner removed at a 45° angle to shorten two sides of the radiator element 24 by 0.40 cm as shown. The rectangular radiator element 25 is 1.10 cm by 1.50 cm. The radiator elements 23, 24 and 25 are located on 1.83 cm centers. Each half-wave section 26 is 0.254 cm wide where it extends between radiator elements and conductively joins a pair of adjacent radiator elements diagonally across the space between them. The dielectric sheet 21 and the ground element 22 are each 2.2 cm by 9.0 cm in the broad surface. The antenna is fed at a terminal 27 from a 50 ohm unbalanced coaxial transmission line (not shown) that passes through the ground element from the backside.

The antenna has a broadside beam (principal lobe perpendicular to the antenna surface) at 6032 MHz and an overall aperture efficiency of 95% based on ground element area. The input voltage standing wave ratio (VSWR) is less than 1.05 terminating a 50 ohm line at 6032 MHz and the VSWR is less than 2 over a frequency range of 3.9%. It is believed that the broadside beam indicates all radiator elements are in phase with respect to each other. The overall aperture efficiency figure includes the VSWR mismatch and is based on the theoretical gain $$G = \frac{4\pi A}{\sqrt{(\lambda o)^2}}$$

where A is the ground element area and $\lambda o$ is the free space wavelength.

The antenna's first side lobes in the H plane pattern of maximum gain are 13.6 db and 8.5 db below maximum gain.

The antenna's measured half-power beam width in the H plane at frequency of maximum gain is 22.3°. The theoretical beam width for a uniformly illuminated aperture 9.0 cm long is 27.9°. Such theoretical beam width is based on the formula $$\frac{(50.6)(\lambda o)}{L}$$

where $\lambda o$ is the free space wavelength and L is the length of the aperture (ground element 22) in that plane.

Applicant believes that when the array in FIG. 1 is operating as an antenna with a broadside beam, to a first order approximation there is a phase reversal respectively across each radiator element and each half-wave section. For example, radiator element **23*a* (23*b*) has 180° of phase shift across it between its extreme points 30 and 31 (32 and 33). There are 180° of phase shift along half-wave section 26*a* between junctions 31 and 32. Thus, the currents in radiator elements 23*a* and 23*b*** are in phase with the currents in each other.

Terminal 27 is located on the radiator element 24 off of that radiator element's H coordinate and more specifically centrally along an edge of the radiator element that intersects its E coordinate. When the terminal was moved to the center of the array such as to point 32 where two half-wave sections join, and the radiator element 25 had a corner removed (see dotted line 28) similar to radiator element 24, then the array had a broadside beam direction that was more independent of variations in frequency and variation in the dielectric constant and thickness of the dielectric sheet. In this latter configuration the half power beam width was 24.5° and the first side lobes were −12.8 db and −13.8 db.

The radiator elements of FIG. 1 are arranged with their respective H coordinates extending along a straight line through the radiator elements of the array with the series-connected half-wave sections forming a serpentine feed line. Such an arrangement provides a compact array for high efficiency with wide bandwidth. In general terms, the portions of radiator elements and half-wave sections on one side of the straight line will be of one polarity while the portions on the other side of the straight line will be of opposite polarity.

The corner of the radiator element 24 was removed and the dimensions of radiator element 25 were modified to improve the 50 ohm match at terminal 27.

Figure 4:
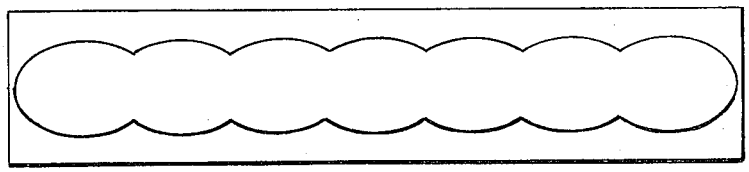
FIG. 4 schematically illustrates the initial copper outline of the antenna of FIG. 3.

The second embodiment utilizing the present invention is an antenna 40 shown in plan view in FIG. 3. The basic structure is a pattern of overlapping ellipses, as shown in FIG. 4. The minor axes of the elipses are 1.55 cm, the major axes are 2.03 cm and the ellipses are located on 1.53 cm centers along their major axes. Notches cut into the overlapping ellipse pattern form the radiator elements 41 interconnected by half-wave sections 42 of serpentine feed line. Such notches are approximately at a 74° angle with respect to a straight line through the array. Each notch is approximately 0.89 mm wide at its open end, tapers linearly to 0.51 mm in width over a distance of 7.62 mm, and then tapers linearly from 0.51 mm in width to zero over a distance of 2.54 mm. Some of radiator elements 41 include copper projections 43 to fine tune the antenna. The radiator elements 41 are located with their H coordinates extending generally along a straight line through the radiator elements of the array to provide a compact, highly efficient array with wide bandwidth. The array is centered on a dielectric sheet 44 that is 2.5 cm by 12.0 cm. The antenna 40 may be fed by an unbalanced 50 ohm coaxial transmission line, the center element of which passes through a hole in the ground element (not shown) and contacts a terminal 45 which is located at the extremity of one of the half-wave sections 42 of the serpentine feed line where it passes through one of the radiator elements 41.

The antenna 40 has a maximum gain with a broadside beam at 5883 MHz and is approximately 100% efficient based on ground element area. The VSWR of the array is less than 2 over a bandwidth of 307 MHz or 5.2%. The half-power beam width of the antenna 40 in the H plane at frequency of maximum gain is 20.5° compared to a theoretical beam width of 21.5° if the aperture were uniformly illuminated. The first side lobes are 12.4 db and 18.5 db below maximum gain.

FIG. 5 shows an antenna 50 where the feedline of half-wave sections 51 is conductively joined to an edge of each radiator element 52 which intersects its E coordinate and is spaced from that edge along most of the length of that edge by less than twice the thickness of the dielectric sheet. The overall dimension A of the array is 1.52 cm. The spacing between the radiator elements 52 and half-wave sections 51 is approximately 0.38 mm wide. The half-wave sections have a width of approximately 0.254 cm and form an angle of 78° with a straight line through the array near the center of each half-wave section. The dimension B of the radiator elements is 1.956 cm and the radiator elements are shortened from the dimension A by the dimension C which is 0.15 cm. The end radiator elements **52*a* and 52*b* of the array are half-size. The array is centered on a dielectric sheet 53 which is 2.35 cm by 9.14 cm. A terminal 54 for connection to an unbalanced transmission line is located at the extremity of one of the half-wave sections 51 where it is conductively connected to the edge of the radiator element 52*a*. Radiator element 52*a* has been lengthened slightly as shown at 57 to improve the match to 50 ohms at terminal 54** and provide a VSWR of less than 1.05 at 5885 MHz.

The H plane beam of antenna 50 is tilted 22° from broadside away from the terminal 54 indicating the halfwave sections are longer than necessary for a broadside beam. It is believed that the signal on the feedline is reflected at radiator element **52*b* to produce a second beam that appears as a −7.2 db side lobe 22° off broadside toward the terminal 54. The other first side lobe is −22 db. The antenna 50** has a VSWR less than 2 over a frequency range greater than 8%.

The resonant energy in the dipole radiator elements 52 is coupled to the sections 51 of the feed line to apparently reduce the phase shift per unit length of feed line. Again, it is believed this property is utilized to enable the arrangement of the radiator elements 52 with their H coordinates generally along a straight line through the radiator elements of the array to provide a compact array. It is also believed that such coupling tends to make the array more stable with respect to changes in frequency (provide a wider bandwidth).

Other preferred locations for the terminal are at points 55 and 56.

Figure 6:
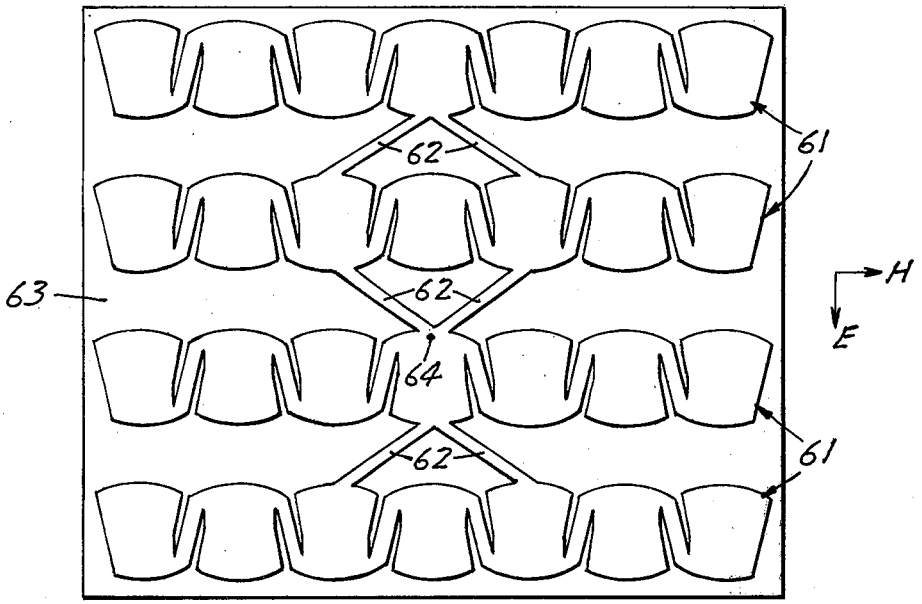
FIG. 6 is a plan view of a fourth embodiment of the invention wherein a plurality of arrays are interconnected by bridge elements.

FIG. 6 shows an antenna employing four essentially identical arrays 61, each similar to the antenna array 40 in FIG. 3. The arrays 61 are on 2.54 cm centers in the E coordinate direction. The arrays are interconnected by bridge elements 62. Each bridge element 62 is 0.2 cm wide and provides approximately a phase reversal from end to end at the operating wavelength $\lambda o$. Each bridge element conductively joins two two terminals that are of opposite phase and on separate arrays. The characteristic impedance of the bridge elements when considered as transmission lines can be determined from Wheeler's Wide Strip Approximation Chart. Other properties of the bridge elements 62 are described in my copending application Ser. No. 623,988 and are incorporated herein by reference. The antenna arrays are on a dielectric sheet 63 that is 11.2 cm in the H coordinate direction and 9.7 cm in the E coordinate direction in the broad surface. The antenna is fed at a terminal 64 by an unbalanced 50 ohm transmission line (not shown) from its backside.

The antenna beam is broadside at 5948 MHz and has an input VSWR of 3.5 into 50 ohms at such frequency. This antenna has an overall aperture efficiency of 62% including the mismatch loss at terminal 64 and an inherent efficiency of 87% when the mismatch loss at terminal 64 is discounted. A small coaxial impedance transformer would be desirable to match this antenna to 50 ohms.

The half power beam width for the H plane pattern is 22.5° which is approximately the theoretical value for a uniformly illuminated apperture. The half power beam width for the E plane pattern is 28.5° compared to 26.3° theoretical for a uniformly illuminated aperture.

The first (and highest) side lobes in the H plane are −14.5 db and −15 db and in the E plane are −14 db and −18 db.

It is believed that in this antenna each radiator element within an array radiates substantially in phase with respect to the other radiator elements within its array and that each array of radiator elements radiates substantially in phase with respect to its adjacent arrays.

Figure 7:
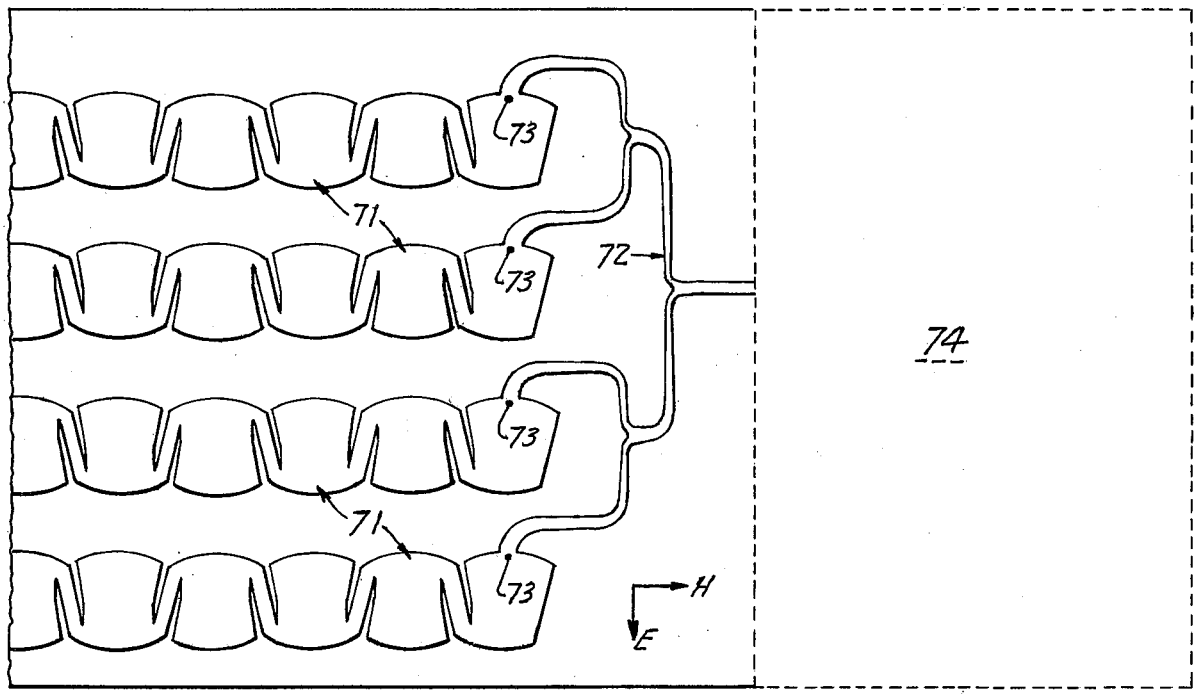
FIG. 7 is a plan view of a fifth embodiment of the invention wherein a plurality of arrays are interconnected by a conventional corporate feed network.

FIG. 7 shows an antenna of four essentially identical arrays 71 which are interconnected and fed energy via a corporate feed network 72. Each array 71 is similar to the antenna array 40 in FIG. 3. The arrays are on 2.54 cm centers in the E coordinate dimension for convenience only. A terminal 73 on each array impedance matches and connects to the corporate feed network 72. Such corporate feed networks are well known in the art as described in the background section of this application. The corporate feed network 72 connects to a microwave circuit 74, located on the same dielectric sheet, thus eliminating the need for connectors. The corporate feed network 72 can be designed such that the arrays 71 radiate in phase with respect to each other. The radiator elements within the arrays can be designed to radiate in phase with respect to each other as previously described.

What is claimed is:

1. A microstrip antenna for radiating or detecting electromagnetic signals having a wavelength $\lambda o$ comprising:

a dielectric sheet of relative dielectric constant $\epsilon_r$, relative permeability $\mu_r$ and uniform thickness $t$ having a. on a first broad surface 1. at least three thin conductive resonant dipole radiator elements, each radiator element having two orthogonal coordinates that respectively define E and H planes of electromagnetic radiation for said radiator element, with the E plane coordinate dimension of each radiator element being approximately one half the dielectric wavelength $$\frac{\lambda o}{\sqrt{\epsilon_r \mu_r}}$$

2. said radiator elements conductively joined by thin conductive strips into an array or arrays of at least three radiator elements; and 3. a terminal for connecting each array to a transmission line, b. on the other broad surface an essentially continuous thin conductive ground element more than coextensive with the radiator elements which defines a radiator aperture;

wherein the improvement comprises:

a. said conductive strips comprise at least one feed line consisting of similar, series-connected, semi-resonant, approximately half-wave sections, each feed line having a maximum width that is less than one-fourth the dielectric wavelength where the feed line sections extend between adjacent radiator elements;

b. the radiator elements are conductively joined to alternate sides of each feed line at successive junctions of its half-wave sections to provide an array, the feed line being electrically coupled to each radiator element in said array along an edge of the radiator element which intersects its E coordinate;

c. a terminal for connecting the array to a transmission line is located on a radiator element off that radiator element's H coordinate or at the junction of two said half-wave sections.

2. A microstrip antenna recited in claim 1 wherein the terminal is located at one of the edges of the radiator element that intersects the radiator element's E coordinate.

3. A microstrip antenna recited in claim 1 wherein the terminal is located at the junction of two said half-wave sections.

4. A microstrip antenna recited in claim 1 wherein the length of the half-wave sections is such that all the radiator elements in an array radiate substantially in phase with respect to each other.

5. A microstrip antenna recited in claim 1 wherein the portions of the feed line sections which extend between adjacent radiator elements have a maximum width that is less than one-sixth the dielectric wavelength.

6. A microstrip antenna recited in claim 5 wherein the terminal is located at one of the edges of the radiator element that intersects the radiator element's E coordinate.

7. A microstrip antenna recited in claim 5 wherein the terminal is located at the junction of two said half-wave sections.

8. A microstrip antenna recited in claim 5 wherein the length of the half-wave sections is such that all the radiator elements in an array radiate substantially in phase with respect to each other.

9. A microstrip antenna recited in claim 5 wherein the feed line passes through each connected radiator element adjacent an edge which intersects the radiator element's E coordinate.

10. A microstrip antenna recited in claim 5 wherein the feed line is conductively joined to an edge of each radiator element which intersects its E coordinate and is spaced from that edge along most of the length of that edge by less than twice the thickness of the dielectric sheet.

11. A microstrip antenna recited in claim 1 wherein the portions of the feed line sections which extend between adjacent radiator elements have a maximum width that is less than one-eighth the dielectric wavelength.

12. A microstrip antenna recited in claim 11 wherein the terminal is located at one of the edges of the radiator element that intersects the radiator element's E coordinate.

13. A microstrip antenna recited in claim 11 wherein the terminal is located at the junction of two said half-wave sections.

14. A microstrip antenna recited in claim 11 wherein the length of the half-wave sections is such that all the radiator elements in an array radiate substantially in phase with respect to each other.

15. A microstrip antenna recited in claim 1 wherein there are at least two arrays arranged side by side on the first broad surface with at least one terminal on each array.

16. A microstrip antenna recited in claim 15 further including a thin conductive strip corporate feed network located on said first broad surface and connected to said terminal on each array to provide a common point for connection to a transmission line.

17. A microstrip antenna recited in claim 16 wherein the corporate feed network is so connected that each array of radiator elements radiates substantially in phase with respect to at least one adjacent array.

18. A microstrip antenna recited in claim 16 wherein the length of the half-wave sections is such that all the radiator elements in an array radiate substantially in phase with respect to each other.

19. A microstrip antenna recited in claim 15 further including one or more interarray bridge elements, each interarray bridge element having a width that provides a characteristic impedance between 10 and 175 ohms and a length that provides approximately a phase reversal from end to end at the operating wavelength $\lambda o$, each said interarray bridge element conductively joining two terminals with said two terminals being of opposite phase and located on separate arrays.

20. A microstrip antenna recited in claim 19 wherein each interarray bridge element has a width providing a characteristic impedance between 20 and 100 ohms.

21. A microstrip antenna recited in claim 20 wherein the length of each bridge element is such that each array of radiator elements radiates substantially in phase with respect to the adjacent arrays to which it is interconnected by bridge elements.

22. A microstrip antenna recited in claim 20 wherein the length of the half-wave sections is such that all the radiator elements in an array radiate substantially in phase with respect to each other.

23. The method of radiating or detecting electromagnetic signals having the wavelength $\lambda o$ using an antenna as defined in claim 1 involving applying or receiving signals of wavelength $\lambda o$ at said terminal, which signals are distributed to or from radiator elements that are electrically farther from said terminal by utilizing the phase reversal property that exists along said series-connected half-wave sections of feed line electrically closer to said terminal.

24. The method of radiating or detecting electromagnetic signals having the wavelength $\lambda o$ using an antenna as defined in claim 5 involving applying or receiving signals of wavelength $\lambda o$ at said terminal, which signals are distributed to or from radiator elements that are electrically farther from said terminal by utilizing the phase reversal property that exists along said series-connected half-wave sections of feed line electrically closer to said terminal.

25. The method of radiating or detecting electromagnetic signals having the wavelength $\lambda o$ using an antenna as defined in claim 11 involving applying or receiving signals of wavelength $\lambda o$ at said terminal, which signals are distributed to or from radiator elements that are electrically farther from said terminal by utilizing the phase reversal property that exists along said series-connected half-wave sections of feed line electrically closer to said terminal.

26. A microstrip antenna for radiating or detecting electromagnetic signals having a wavelength $\lambda o$ comprising:

a dielectric sheet of relative dielectric constant $\epsilon_r$, relative permeability $\mu_r$ and uniform thickness $t$ having a. on a first broad surface 1. at least three thin conductive resonant dipole radiator elements, each radiator element having two orthogonal coordinates that respectively define E and H planes of electromagnetic radiation for said radiator element, with the E plane coordinate dimension of each radiator element being approximately one half the dielectric wavelength $$\frac{\lambda o}{\sqrt{\epsilon_r \mu_r}},$$

2. said radiator elements conductively joined by thin conductive strips into an array or arrays of at least three radiator elements; and
3. a terminal for connecting each array to a transmission line, b. on the other broad surface an essentially continuous thin conductive ground element more than coextensive with the radiator elements which defines a radiator aperture;

wherein the improvement comprises:

a. said conductive strips comprise at least one serpentine feed line consisting of similar, series-connected, semi-resonant, approximately half-wave sections, each serpentine feed line having a maximum width that is less than one-sixth the dielectric wavelength where the feed line sections extend between adjacent radiator elements;

b. the radiator elements are conductively joined to alternate sides of each serpentine feed line at successive junctions of its half-wave sections to provide an array, the radiator elements in the array are arranged with their H coordinates extending generally along a straight line through the radiator elements of the array, the serpentine feed line being electrically coupled to each radiator element in said array along an edge of the radiator element which intersects its E coordinate; and c. a terminal for connecting the array to a transmission line is located on a radiator element off that radiator element's H coordinate or at the junction of two said half-wave sections.

27. A microstrip antenna recited in claim 26 wherein the length of the half-wave sections is such that all the radiator elements in an array radiate substantially in phase with respect to each other.

28. A microstrip antenna recited in claim 26 wherein the feed line passes through each connected radiator element adjacent an edge which intersects the radiator element's E coordinate.

29. A microstrip antenna recited in claim 28 wherein the terminal is located at one of the edges of the radiator element which intersects its E coordinate, with the first said edge being the edge said radiator element shares with the feed line, and the second said edge being opposite said first edge.

30. A microstrip antenna recited in claim 28 wherein the terminal is located on a central radiator element of the array.

31. A microstrip antenna recited in claim 26, wherein the feed line is conductively joined to an edge of each radiator element which intersects its E coordinate and is spaced from that edge along most of the length of that edge by less than twice the thickness of the dielectric sheet.

32. A microstrip antenna recited in claim 31 wherein the terminal is located at the edge of a radiator element opposite to the edge to which the feed line is conductively joined.

33. A microstrip antenna recited in claim 32 wherein the terminal is located on a central radiator element in said array.

34. A microstrip antenna recited in claim 31 wherein the terminal is located on the feed line at the junction of two half-wave sections and near the center of said array.

35. A microstrip antenna recited in claim 26 wherein the portions of the feed line sections which extend between adjacent radiator elements have a maximum width less than one-eighth the dielectric wavelength.

36. A microstrip antenna recited in claim 35 wherein the length of the half-wave sections is such that all the radiator elements in an array radiate substantially in phase with respect to each other.

37. A microstrip antenna recited in claim 35 wherein the terminal is located at one of the edges of the radiator element that intersects the radiator element's E coordinate.

38. A microstrip antenna recited in claim 35 wherein the terminal is located at the junction of two said half-wave sections.

39. A microstrip antenna recited in claim 26 wherein there are at least two arrays arranged side by side on the first broad surface with at least one terminal on each array.

40. A microstrip antenna recited in claim 39 wherein the length of the half-wave sections is such that all the radiator elements in an array radiate substantially in phase with respect to each other.

41. A microstrip antenna recited in claim 39 further including a thin conductive strip corporate feed network located on said first broad surface and connected to said terminal on each array to provide a common point for connection to a transmission line.

42. A microstrip antenna recited in claim 39 further including one or more interarray bridge elements, each interarray bridge element having a width that provides a characteristic impedance between 10 and 175 ohms and a length that provides approximately a phase reversal from end to end at the operating wavelength $\lambda o$, each said interarray bridge element conductively joining two terminals with said two terminals being of opposite phase and located on separate arrays.

43. A microstrip antenna recited in claim 42 wherein each interarray bridge element has a width providing a characteristic impedance between 20 and 100 ohms.

44. The method of radiating or detecting electromagnetic signals having the wavelength $\lambda o$ using an antenna as defined in claim 26 involving applying or receiving signals of wavelength $\lambda o$ to at least one terminal, which signals are distributed to or from radiator elements that are electrically farther from said terminal by utilizing the phase reversal property that exists along said series-connected half-wave sections of the feed line electrically closer to said terminal.

45. The method of radiating or detecting electromagnetic signals having the wavelength $\lambda o$ using an antenna as defined in claim 35 involving applying or receiving signals of wavelength $\lambda o$ to at least one terminal, which signals are distributed to or from radiator elements that are electrically farther from said terminal by utilizing the phase reversal property that exists along said series-connected half-wave sections of the feed line electrically closer to said terminal.

* * * * *

UNITED STATES PATENT AND TRADEMARK OFFICE

CERTIFICATE OF CORRECTION

PATENT NO. : 3,995,277

DATED : November 30, 1976

INVENTOR(S) : Murray Olyphant, Jr.

It is certified that error appears in the above-identified patent and that said Letters Patent are hereby corrected as shown below:

Column 3, line 36, change "such" to -- Such --.

Column 7, line 37, change "$\mu_4$" to -- $\mu_r$ --.

Signed and Sealed this

Eighth Day of March 1977

[SEAL]

*Attest:*

RUTH C. MASON
*Attesting Officer*

C. MARSHALL DANN
*Commissioner of Patents and Trademarks*